US006326991B1

(12) United States Patent
Kinjyo et al.

(10) Patent No.: US 6,326,991 B1
(45) Date of Patent: Dec. 4, 2001

(54) THERMAL TRANSFER APPARATUS EQUIPPED WITH INK RIBBON UNIFORM SEPARATION MEANS

(75) Inventors: Kazuaki Kinjyo; Mitsuru Sawano, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/095,930

(22) Filed: Jun. 12, 1998

(30) Foreign Application Priority Data

Jun. 13, 1997 (JP) ..... 9-156997

(51) Int. Cl.[7] ..... B41J 35/04; B41J 17/30
(52) U.S. Cl. ..... 347/216; 400/248
(58) Field of Search ..... 400/242, 246, 400/247, 248, 234; 347/216

(56) References Cited

FOREIGN PATENT DOCUMENTS 61-16878 * 1/1986 (JP) ..... 347/216
7-178993 * 7/1995 (JP) ..... 347/216
07-266649 A 10/1995 (JP) .
09-039349 A 2/1997 (JP) .
9-123494 * 5/1997 (JP) ..... 347/216

* cited by examiner

*Primary Examiner*—Huan Tran
(74) *Attorney, Agent, or Firm*—Sughrue, Mion, Zinn, Macpeak & Seas, PLLC

(57) ABSTRACT

In an ink ribbon separation device for use with a thermal transfer apparatus having a separation bar, the shape of the separation bar is such that the thickness of the bar in an ink ribbon travelling direction is greater at its center in the direction orthogonal to the ink ribbon travelling direction than that at the ends thereof. The center bulges in a downstream direction in a bow shape at a rate of 10 to 200 $\mu$m with respect to a toner width of 100 mm.

9 Claims, 5 Drawing Sheets

THERMAL TRANSFER APPARATUS EQUIPPED WITH INK RIBBON UNIFORM SEPARATION MEANS

BACKGROUND OF THE INVENTION

1. Field of the Invention

The present invention relates to the uniform separation of an ink ribbon of a thermal transfer apparatus, and more particularly, to a thermal transfer apparatus equipped with ink ribbon uniform separation means, which prints an image on an image receiving sheet by way of an ink ribbon and through use of a thermal head, the means reliably and simultaneously separating the ink ribbon at all points in a widthwise direction thereof.

2. Description of the Related Art

FIG. 10 is a perspective view showing the principal elements of a thermal transfer apparatus to which the present invention is applied. In FIG. 10, reference numeral 1 designates a thermal head; 2 designates a platen disposed opposite to the thermal head 1; 3 designates a pair of conveyor rollers for carrying an image-receiving sheet 4; 5 designates an ink ribbon; 6 designates a separation bar; 7 designates a guide roller for the ink ribbon 5; and 8 designates a core for taking up the ink ribbon 5. In this thermal transfer apparatus, after ink has been thermally transferred to the image-receiving sheet 4 from the ink ribbon 5 by the application of heat to the thermal head 1, the image-receiving sheet 4 is separated from the ink ribbon 5. The separation bar 6 is provided for simultaneously separating the ink ribbon 5 from the image-receiving sheet 4 at all points in a widthwise direction.

Despite the aforementioned configuration, the prior art suffers from a problem that the ink ribbon 5 fails to simultaneously separate from the image-receiving sheet 4 at all points in the primary scanning direction (i.e., the widthwise direction of the ink ribbon or the image-receiving sheet) after the printing operation. This is attributable to a tendency that in the existing thermal transfer apparatus, slight tension is applied to the center of the ink ribbon and the image-receiving sheet, while strong tension is applied to the side edges of the image-receiving sheet.

Accordingly, since uneven tension is applied to the ink ribbon and the image-receiving sheet in the widthwise direction thereof, they are quickly separated at the side edges or slowly separated at their center in an upstream direction, thus resulting in irregularities in the separation of the ribbon from the sheet. In the event of such separation irregularities, ink is unevenly transferred to the image-receiving sheet, resulting in an ink transfer failure.

Japanese Patent Unexamined Publication No. Hei. 9-39349 describes the idea that a separation bar has a thickness in its center differing from that of the ends thereof, but fails to quantitatively disclose the thickness.

SUMMARY OF THE INVENTION

The present invention has been made in view of the foregoing circumstances, and an object of the present invention is to solve the foregoing problem in the prior art, and to provide an ink ribbon separation device for use with a thermal transfer apparatus, the device being capable of preventing a transfer failure due to a separation failure.

To achieve the foregoing object, according to a first aspect of the present invention, there is provided a thermal transfer apparatus having a separation bar, wherein the thickness of the separation bar in an ink ribbon travelling direction is greater at its center in the direction orthogonal to the ink ribbon travelling direction than at the ends thereof; and the center bulges in a downstream direction in a bow shape at a rate of 10 to 200 $\mu$m with respect to a toner width of 100 mm.

According to a second aspect of the present invention, there is provided a thermal transfer apparatus having a thermal head and a separation bar, wherein a spacer is interposed between the thermal head and the center of the separation bar in the direction orthogonal to an ink ribbon travelling direction; and the ends of the spacer are curved toward the thermal head at a rate of 10 to 200 $\mu$m with respect to a toner width of 100 mm.

According to a third aspect of the present invention, there is provided a thermal transfer apparatus having a separation bar, wherein a bottom portion of the separation bar in the vertical direction is lower at its center in a direction orthogonal to an ink ribbon travelling direction than that at the ends thereof, at a rate of 10 to 200 $\mu$m relative to a toner width of 100 mm.

According to a fourth aspect of the present invention, there is provided a thermal transfer apparatus having a separation bar, wherein the center of the separation bar in a direction orthogonal to an ink ribbon travelling direction is provided with Teflon coating so that a frictional coefficient of the center of an area of the separation bar which comes into contact with an ink ribbon is smaller than that at the ends thereof.

According to a sixth aspect of the present invention, there is provided a thermal transfer apparatus having a guide roller for guiding an ink ribbon, wherein the guide roller has a spindle or stepped shape and has at its center a thickness greater than that at the ends thereof in the axial direction of the roller. The guide roller having a spindle or stepped shape is curved at a rate of 10 to 200 $\mu$m with respect to a toner width of 100 mm.

According to an eighth aspect of the present invention, there is provided a thermal transfer apparatus having a core for taking up an ink ribbon, wherein the core has a spindle or stepped shape and has at its center a thickness greater than that at the ends thereof in the axial direction of the core.

According to a ninth aspect of the present invention, there is provided a thermal transfer apparatus having a thermal head and a separation bar, and an ink ribbon press member having a high frictional coefficient is interposed between the thermal head and the separation bar.

As mentioned above, the thermal transfer apparatus prevents nonuniform separation of the ink ribbon from the sheet in the widthwise direction by changing tension of the ink ribbon in the widthwise direction at a position downstream of the thermal transfer apparatus so that uniform tension is applied, which results in prevention of a transfer failure.

DETAILED DESCRIPTION OF THE INVENTION

Preferred embodiments of the present invention will be described in detail by reference to the accompanying drawings. An explanation will be principally given of embodiments comprising a separation bar 6, a guide roller 7 for an ink ribbon, and a core 8 for taking up the ink ribbon, all of which have unique shapes.

Figure 1:
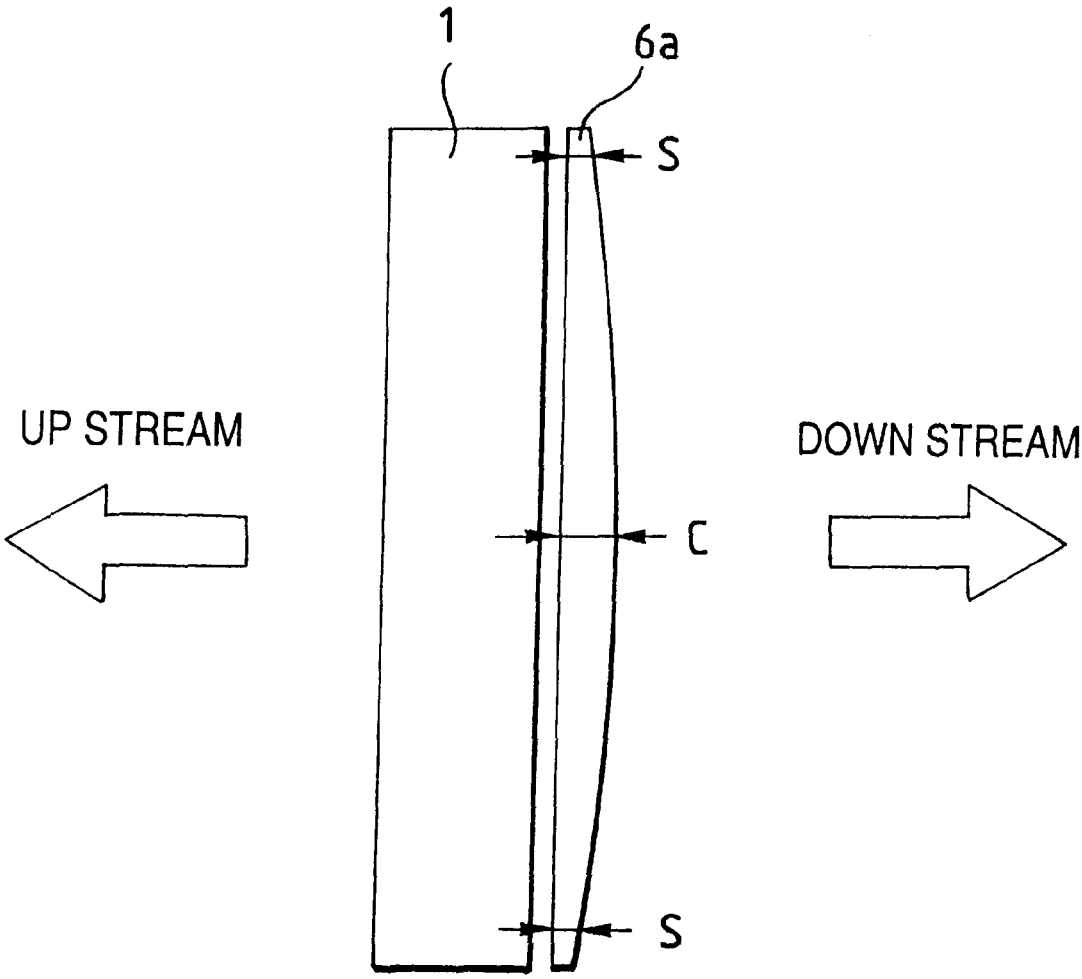
FIG. 1 is a top view showing a separation bar according to the first aspect of the present invention.

FIG. 1 is a top view showing a separation bar according to the first aspect of the present invention. According to the first embodiment, the thickness of a separation bar 6a in an ink ribbon travelling direction is greater at its center C in a direction orthogonal to the ink ribbon travelling direction than that at the ends S thereof, and the separation bar bulges in a downstream direction in the form of a bow shape. In short, the separation bar 6*a* bulges at its center in a width direction and tapers down to its ends. As a result, the center C of the separation bar 6*a* applies the maximum tension to the ink ribbon 5 positioned downstream of the thermal head 1, and the tension symmetrically diminishes toward the ends S of the separation bar 6*a*. There exists a correlation relating to a difference in thickness between the center C and the ends S. As a result of several experiments, the desirable relationship between a toner width and the amount of protuberance of the center C of the separation bar 6*a* was found to be a rate of 10–200 $\mu$m (particularly preferably, a rate of 30 to 100 $\mu$m) with respect to a toner width of 100 mm. Accordingly, in the present embodiment, the center C should bulge at a rate of 50 to 500 $\mu$m, more preferably at a rate of 200 $\mu$m, with respect to a toner width of 330 mm. As a result, uniform tension is applied to the ink ribbon and the image-receiving sheet in their widthwise direction, preventing nonuniform separation of the ink ribbon from the sheet in an upstream position relative to the separation bar.

Figure 2:
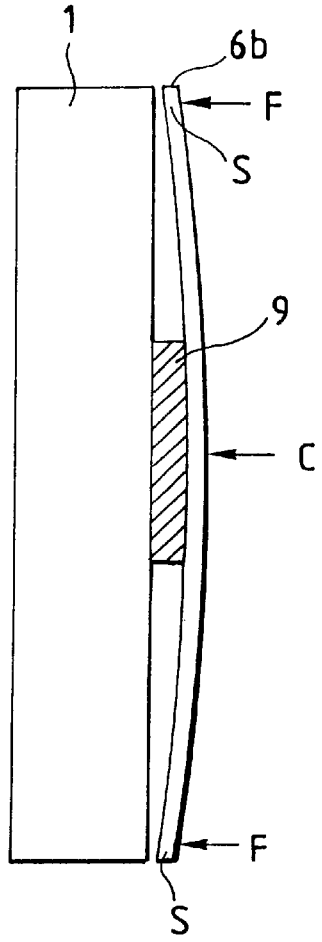
FIG. 2 is a top view showing a separation bar according to the second aspect of the present invention.

FIG. 2 is a top view showing a separation bar according to the second aspect of the present invention. A spacer 9 is interposed between the center C of a separation bar 6*b* in a direction orthogonal to an ink ribbon travelling direction and the thermal head 1. The ends S of the separation bar 6*b* are screwed to the thermal head 1, thus curving the separation bar 6*b* in a direction designated by arrow F toward the side of the thermal head 1. By virtue of such a configuration, the center C applies the maximum tension to the ink ribbon in an upstream position relative to the separation bar 6*b*, and the tension symmetrically diminishes toward the ends S, as in the case of the separation bar shown in FIG. 1. Coupled with the tensile characteristics of the thermal transfer apparatus, uniform tension is eventually applied to the ink ribbon and the image-receiving sheet in their widthwise direction, thus preventing them from being nonuniformly separated from each other in an upstream position relative to the separation bar.

The difference between the thickness of the center C of the separation bar and that of the ends S is the same as that of the separation bar shown in FIG. 1. As a result of several experiments, the desirable relationship between a toner width and the amount of protuberance of the center C of the separation bar 6*a* was found to be a rate of 10–200 $\mu$m (particularly preferably, a rate of 30 to 100 $\mu$m) with respect to a toner width of 100 mm. Accordingly, in the present embodiment, the center C should be bulged at a rate of 50 to 500 $\mu$m, more preferably at a rate of 200 $\mu$m, with respect to a toner width of 330 mm. As a result, uniform tension is applied to the ink ribbon and the image-receiving sheet in their widthwise direction, preventing nonuniform separation of the ink ribbon from the sheet in an upstream position relative to the separation bar.

Figure 3:
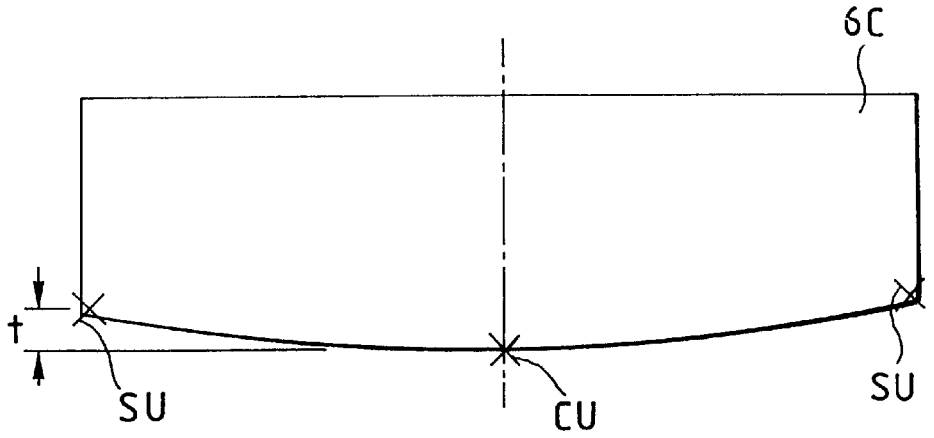
FIG. 3 is a front view showing a separation bar according to the third aspect of the present invention.

FIG. 3 is a front view showing a separation bar 6*c* according to the third aspect of the present patent invention. The lower end of the separation bar 6*c* in the vertical direction has such a configuration that its center CU in a direction orthogonal to an ink ribbon travelling direction is lower than its ends SU by an amount of "t." Through use of the separation bar 6*c* having such a configuration, the center portion CU applies the maximum tension to the ink ribbon 5 in an upstream position relative to the separation bar 6*c*, and the tension symmetrically diminishes towards the ends SU. Coupled with the tensile characteristics of the thermal transfer apparatus, uniform tension is eventually applied to the ink ribbon and the image-receiving sheet in their widthwise direction, thus preventing them from being nonuniformly separated from each other in an upstream position relative to the separation bar. The difference between the thickness of the center CU of the separation bar 6*c* and that of the ends SU of the same is the same as that of the separation bar shown in FIG. 1.

Figure 4:
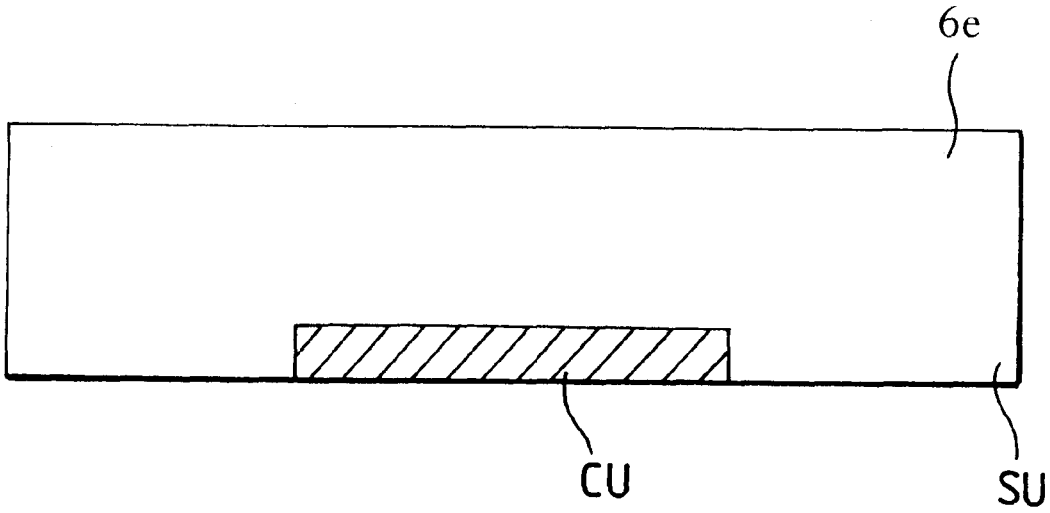
FIG. 4 is a front view showing a separation bar according to the fourth aspect of the present invention.

FIG. 4 is a front view showing a separation bar 6*d* according to the fourth aspect of the present invention. The center CU of the separation bar 6*d* is formed so as to have a low frictional coefficient in a widthwise direction. The center CU applies the maximum tension to the ink ribbon 5 positioned in a downstream position relative to the thermal head 1, and the tension symmetrically diminishes toward the ends SU of the separation bar 6*d*. By virtue of the foregoing configuration, even if the ink ribbon and the image-receiving sheet are withdrawn in the downstream direction by uniform force, the maximum withdrawing force is exerted on the area of the ink ribbon 5 around the center CU in an upstream position relative to the separation bar 6*d*, and the force symmetrically diminishes towards the ends SU. Coupled with the tensile characteristics of the thermal transfer apparatus, uniform tension is eventually applied to the ink ribbon and the image-receiving sheet in their widthwise direction, thus preventing them from being nonuniformly separated from each other in an upstream position relative to the separation bar.

The method of reducing the frictional coefficient of the center of the separation bar according to the present embodiment includes a method of covering with Teflon coating the hatched center portion of the separation bar 6*d* with respect to its widthwise direction (about half the entire width).

Figure 5:
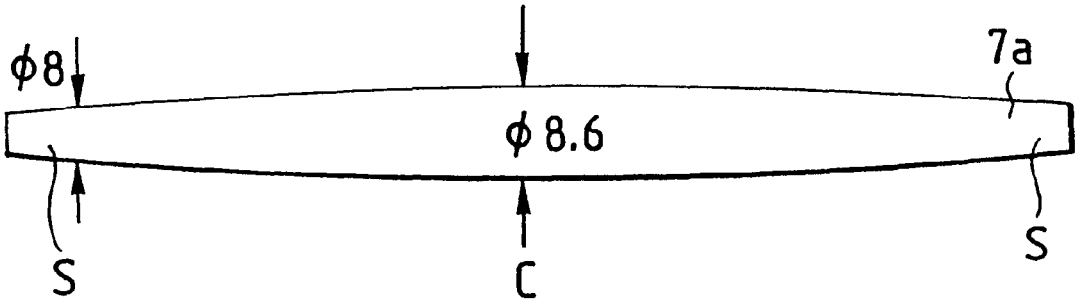
FIG. 5 is a side view showing a guide roller for guiding an ink ribbon according to a first example of the sixth aspect of the present invention.

FIG. 5 is a side view showing a guide roller 7*a* for an ink ribbon according to the first example of the sixth aspect of the present invention. The guide roller 7*a* according to the first example bulges at the center C, and the thickness of the guide roller 7*a* decreases continuously toward the ends S thereof. The center C of the guide roller 7*a* applies the maximum tension to the ink ribbon 5 in an upstream position relative to the guide roller, and the tension symmetrically diminishes towards the ends S of the guide roller. There exists a correlation relating to a difference between the center C and the ends S. As a result of several experiments, the desirable relationship between a toner width and the diameter of the guide roller 7*a* was found to be a rate of 10–200 $\mu$m (particularly preferably, a rate of 30 to 100 $\mu$m) with respect to a toner width of 100 mm. The greater the width of the guide roller, the larger the diameter of the same. Accordingly, according to the first example, the center C of the guide roller 7*a* bulges at a rate of 50 to 500 $\mu$m, more preferably at a rate of 200 $\mu$m, with respect to a toner width of 330 mm. As a result, the center C applies the maximum tension to the ink ribbon 5 positioned in a downstream position relative to the thermal head 1, and the tension symmetrically diminishes toward the ends S of the guide roller 7*a*. Coupled with the tensile characteristics of the thermal transfer apparatus, uniform tension is eventually applied to the ink ribbon and the image-receiving sheet in their widthwise direction, thus preventing them from being nonuniformly separated from each other in an upstream position relative to the separation bar.

Figure 6:
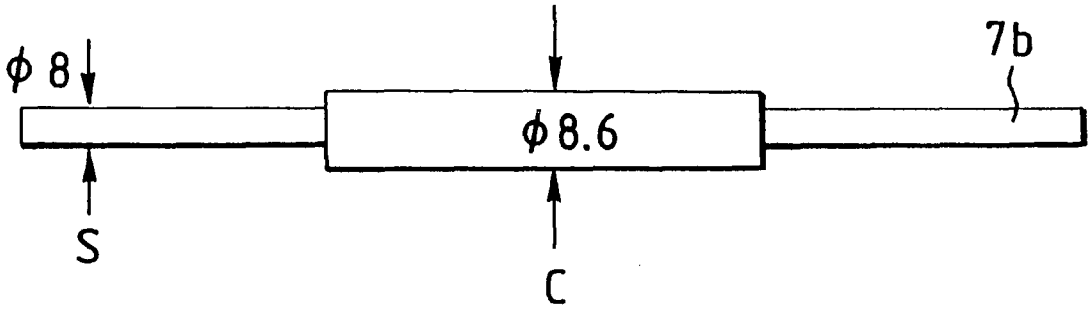
FIG. 6 is a side view showing a guide roller for guiding an ink ribbon according to a second example of the sixth aspect of the present invention.

FIG. 6 is a side view showing a guide roller 7*b* for an ink ribbon according to the second example of the sixth aspect of the present invention. The guide roller 7*b* according to the second example bulges at the center C, and the thickness of the guide roller 7*b* decreases stepwise toward the ends S thereof. The center C of the guide roller 7*a* applies the maximum tension to the ink ribbon 5 in a downstream position relative to the thermal head 1, and the tension symmetrically diminishes towards the ends S of the guide roller. The correlation between the thickness of the center C and the thickness of the ends S is the same as that of the guide roller shown in FIG. 5. By virtue of the foregoing configuration, the maximum withdrawing force is exerted on the area of the ink ribbon 5 around the center C in an upstream position relative to the thermal head 1, and the force symmetrically diminishes towards the ends S. Coupled with the tensile characteristics of the thermal transfer apparatus, uniform tension is eventually applied to the ink ribbon and the image-receiving sheet in their widthwise direction, thus preventing them from being nonuniformly separated from each other in an upstream position relative to the separation bar.

Although the guide roller 7*a*, which is shown in FIG. 5 and has its greatest thickness at the center C and the thickness decreases continuously toward the ends S thereof, is troublesome to manufacture, the guide roller 7*b* having a profile such as that shown in FIG. 6 is easy to manufacture. In effect, even the latter guide roller 7*b* sufficiently prevents nonuniform separation of the ink ribbon from the image-receiving sheet.

Figure 7:
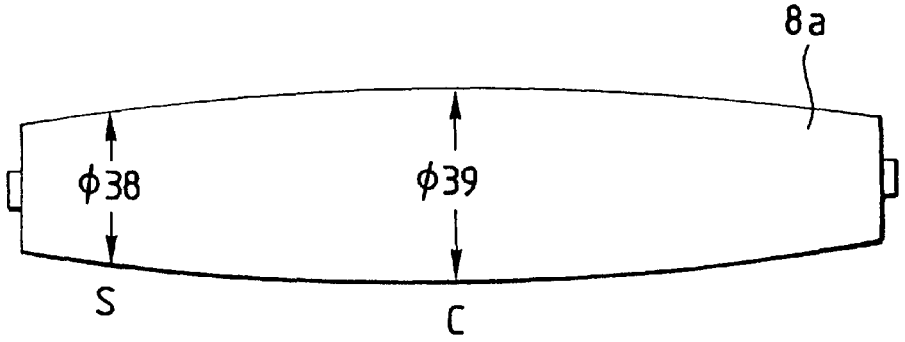
FIG. 7 is a side view showing a core for taking up an ink ribbon according to a first example of the eighth aspect of the present invention.

FIG. 7 is a side view showing a core 8*a* for taking up an ink ribbon according to the first example of the eighth aspect of the present invention. The take-up core 8*a* according to the first example bulges at the center C in the widthwise direction, and the diameter of the take-up roller 8*a* decreases continuously toward the ends S thereof. The center C applies the maximum tension to the ink ribbon 5 positioned in a downstream position relative to the thermal head 1, and the tension symmetrically diminishes toward the ends S of the take-up roller 8*a*. The difference in thickness between the center C and the ends S should be set to 0.4 to 2 mm or thereabouts, preferably 0.6 to 1.4 mm, or e.g., 1.0 mm.

By virtue of the foregoing configuration, the maximum withdrawing force is exerted on the area of the ink ribbon around the center C, and the force symmetrically diminishes towards the ends S. Coupled with the tensile characteristics of the thermal transfer apparatus, uniform tension is eventually applied to the ink ribbon and the image-receiving sheet in their widthwise direction, thus preventing them from being nonuniformly separated from each other in an upstream position relative to the separation bar.

Figure 8:
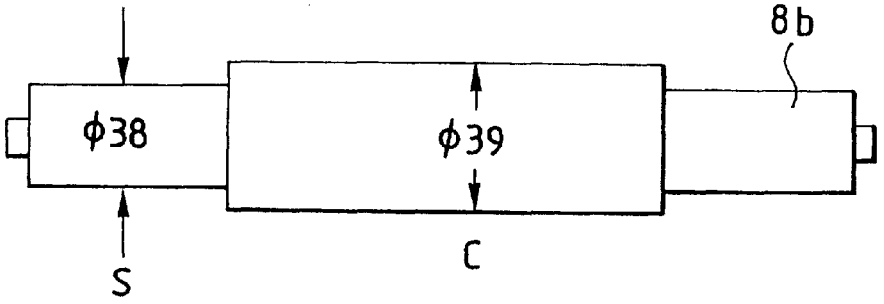
FIG. 8 is a side view showing a core for taking up an ink ribbon according to a second example of the eighth aspect of the present invention.

FIG. 8 is a side view showing a core 8*b* for taking up an ink ribbon according to the second example of the eighth aspect of the present invention. The take-up roller 8*b* according to the second embodiment bulges at the center C, and the thickness of the take-up roller 8*b* decreases stepwise toward the ends S thereof. With this configuration, the center C of the take-up roller 8*b* applies the maximum tension to the ink ribbon 5 in a downstream position relative to the thermal head 1, and the tension symmetrically diminishes towards the ends S of the guide roller. The correlation between the thickness of the center C and the thickness of the ends S is the same as that of the guide roller shown in FIG. 7.

By virtue of the foregoing configuration, the maximum withdrawing force is exerted on the area of the ink ribbon 5 around the center C, and the force symmetrically diminishes towards the ends S. Coupled with the tensile characteristics of the thermal transfer apparatus, uniform tension is eventually applied to the ink ribbon and the image-receiving sheet in their widthwise direction, thus preventing them from being nonuniformly separated from each other in an upstream position relative to the separation bar.

Although the take-up roller 8*a*, which is shown in FIG. 7 and has its greatest thickness at the center C and the thickness decreases continuously toward the ends S thereof, is troublesome to manufacture, the take-up roller 8*b* having a profile such as that shown in FIG. 8 is easy to manufacture. In effect, even the latter take-up roller 8*b* sufficiently prevents nonuniform separation of the ink ribbon from the image-receiving sheet.

Figure 9:
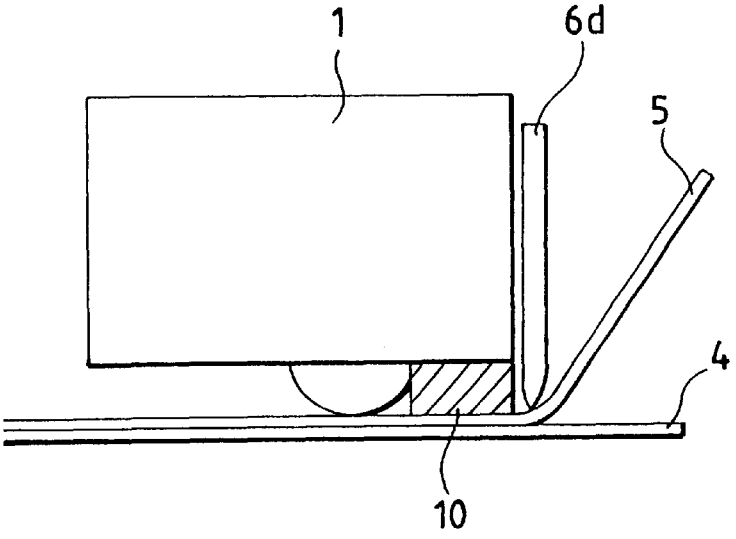
FIG. 9 is a schematic representation showing an ink ribbon press member which is formed of a material of highly frictional coefficient and which is interposed between a thermal head and a separation bar, according to the ninth aspect of the press invention.
Figure 10:
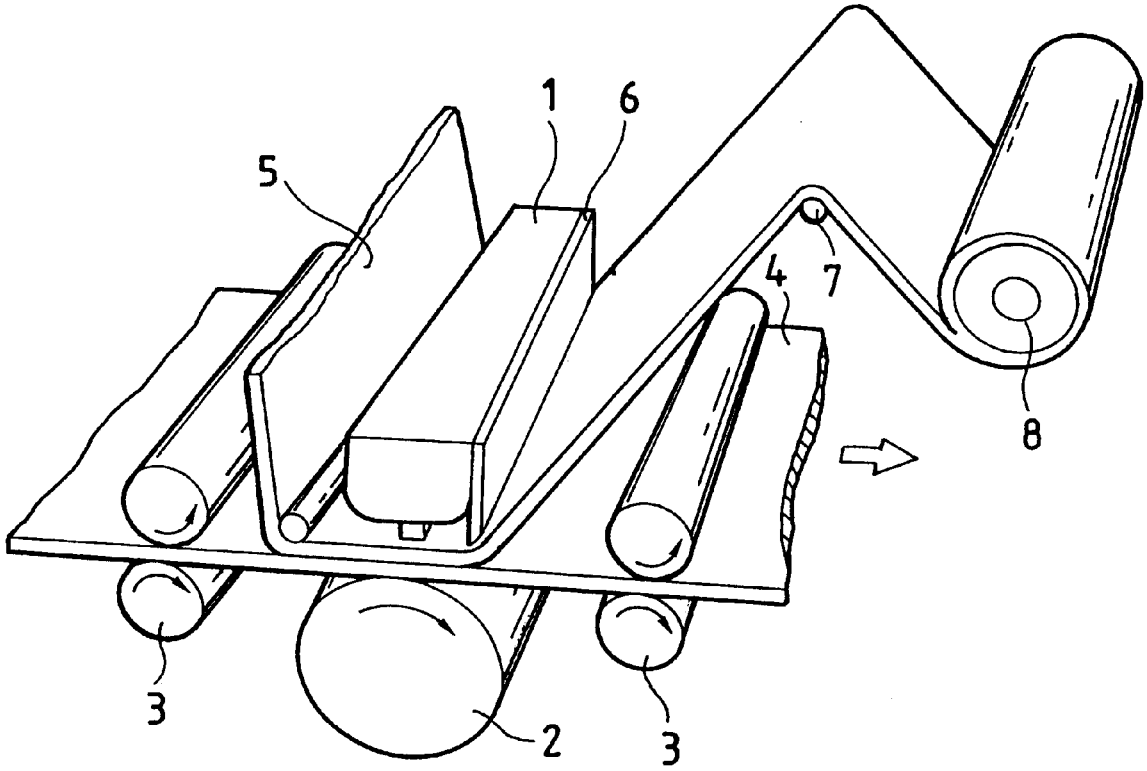
FIG. 10 is a perspective view showing the principal elements of a thermal transfer apparatus to which the present invention is applied.

FIG. 9 is a side view showing a structure of the ninth aspect of the present invention. More specifically, the structure comprises an ink ribbon press member 10 having a high frictional coefficient interposed between the thermal head 1 and the separation bar 6*d*. Although the press member 10 may be provided at each end of the separation bar 6*d*, the press member 10 should be provided over the entire widthwise surface of the separation bar 6*d* in order to ensure prevention of quick separation of the ink ribbon from the image-receiving sheet. Since the ink ribbon is reliably prevented from being quickly separated from the sheet in the area between the thermal head 1 and the separation bar 6*d*, a transfer failure stemming from a separation failure can be prevented.

The ink ribbon press member 10 having a high frictional coefficient according to the second embodiment may be formed from spongy material such as a foaming urethane.

The foregoing embodiments show examples of the present invention. Needless to say, the present invention is not limited to these examples. For example, it is more effective to combine together two or more of the aforementioned elements: that is, the separation bar of any one of the first to fourth aspects or a separation bar formed by combination thereof; the guide roller of the sixth aspect; the take-up core of the eighth aspect; and the ink ribbon press member of the ninth aspect. In such a case where the foregoing elements are used in combination, they exert influence on one another. For this reason, contrary to a case where they are used solely, the elements should be used so as to slightly reduce the numerical values mentioned above.

All the foregoing descriptions are predicated on a thermal transfer apparatus in which small tension is exerted on the center of the ink ribbon and strong tension is exerted on the sides of the same. In some types of thermal transfer apparatus, a few thermal transfer apparatus exist wherein small tension is exerted to the sides of the ink ribbon and strong tension is exerted to the center of the same, in a manner opposite to that of the foregoing type of thermal transfer apparatus. In such a case, according to the idea of the present invention, the separation bar, the guide roller, and the ink-ribbon take-up core have structures completely opposite to those of the corresponding elements mentioned previously. More specifically, in such a case, the thermal transfer apparatus will be constructed as follows.

Constitution of each component of a thermal transfer apparatus in which strong tension is exerted on the center of an ink ribbon and weak tension is exerted to the sides of the ink ribbon:

(1) A separation bar has such a shape that the thickness of the bar in an ink ribbon travelling direction is greater at the ends of the bar in the direction orthogonal to the ink ribbon travelling direction, than that at the center of the bar, and the bar bulges in a downstream direction in the form of a reverse bow shape. The bar is formed into the reverse bow shape at a rate of 10 to 200 $\mu$m with respect to a toner width of 100 mm.

(2) Spacers are interposed between the thermal head and the ends of the separation bar in a direction orthogonal to an ink ribbon travelling direction, and the center of the separation bar is curved toward the thermal head. The bar is curved at a rate of 10 to 200 $\mu$m with respect to a toner width of 100 mm.

(3) The bottom of the separation bar in the vertical direction has such a shape that the bottom portions of the bar at both ends in the direction orthogonal to an ink ribbon travelling direction are lower than the bottom portion of the bar at the center thereof. The bottom of the bar descends at a rate of 10 to 200 $\mu$m with respect to a toner width of 100 mm.

(4) In the area of the separation bar which comes into contact with the ink ribbon, the ends of the bar have a frictional coefficient smaller than that of the center in the direction orthogonal to the ink ribbon travelling direction.

(5) In the area of the separation bar which comes into contact with the ink ribbon, the ends of the bar are covered with Teflon coating.

(6) A guide roller for guiding the ink ribbon is formed into a pincushion or stepped shape. More specifically, in the axial direction of the roller, the guide roller has at its center a smaller diameter and at its ends a greater diameter. The roller is formed so as to become tapered at a rate of 10 to 200 $\mu$m with respect to a toner width of 100 mm.

(7) A core for taking up an ink ribbon is formed into a pincushion or stepped shape. More specifically, in the axial direction of the core, the take-up core has at its center a smaller diameter and at its ends a greater diameter.

(8) An ink ribbon press member having a high frictional coefficient is interposed between a thermal head and the separation bar.

As mentioned previously, an existing thermal transfer apparatus causes a transfer failure stemming from a separation failure, because no consideration is paid to variable control of tension in an ink ribbon in its width direction. In contrast, as has been described in detail, the present invention allows for variable control of tension in the ink ribbon in its widthwise direction and has the remarkable effect of being able to realize an ink ribbon separation apparatus which prevents a transfer failure stemming from a separation failure.

What is claimed is:

1. A thermal transfer apparatus equipped with an ink ribbon uniform separation means, comprising:

a separation bar, the separation bar having such a shape that the thickness of the bar in an ink ribbon travelling direction is greater at the center of the bar in a direction orthogonal to the ink ribbon travelling direction than that at ends of the bar, and the center bulges in a downstream direction in a bow shape, wherein the bow shape changes its shape in a width direction of a toner formed on an ink ribbon at a rate of 10 to 200 $\mu$m per 100 mm.

2. A thermal transfer apparatus equipped with ink ribbon uniform separation means, comprising:

a thermal head;

a separation bar; and a spacer interposed between the thermal head and the center of the separation bar in a direction orthogonal to an ink ribbon travelling direction, the ends of the separation bar being curved toward the thermal head, wherein the curved portion of the bar toward the thermal head changes its shape in a width direction of a toner formed on an ink ribbon at a rate of 10 to 200 $\mu$m per 100 mm.

3. A thermal transfer apparatus equipped with ink ribbon uniform separation means, comprising:

a separation bar, a bottom of the separation bar in the vertical direction having such a shape that a bottom portion at the center of the bar in a direction orthogonal to an ink ribbon travelling direction is lower than that at ends of the bar, wherein the bottom portion at the center descends downward in a width direction of a toner formed on an ink ribbon at a rate of 10 to 200 $\mu$m per 100 mm.

4. A thermal transfer apparatus equipped with ink ribbon uniform separation means, comprising:

a separation bar, wherein an area of the separation bar which comes into contact with an ink ribbon has a frictional coefficient at the center of the bar in an ink ribbon travelling direction smaller than that at ends of the bar.

5. A thermal transfer apparatus as defined in claim 4, wherein the center of the area of the separation bar, which comes into contact with the ink ribbon, is covered with a hard, nonstick coating.

6. A thermal transfer apparatus equipped with ink ribbon uniform separation means, comprising:

a guide roller for guiding an ink ribbon, wherein the guide roller has a stepped shape and has at its center a thickness greater than that at the ends thereof in an axial direction of the roller.

7. A thermal transfer apparatus as defined in claim 6, wherein the guide roller having the stepped shape changes its shape in a width direction of a toner formed on the ink ribbon at a rate of 10 to 200 $\mu$m per 100 mm.

8. A thermal transfer apparatus equipped with ink ribbon uniform separation means, comprising:

a core for taking up an ink ribbon, wherein the core has a stepped shape and has at its center a thickness greater than that at the ends thereof in an axial direction of the core.

9. A thermal transfer apparatus equipped with ink ribbon uniform separation means, comprising:

a thermal head;

a separation bar; and an ink ribbon press member having a high frictional coefficient and being interposed between the thermal head and the separation bar.

* * * * *